US008403452B2

(12) United States Patent
Menzel et al.

(10) Patent No.: US 8,403,452 B2
(45) Date of Patent: Mar. 26, 2013

(54) SEPARATION OF DRIVE PULSES FOR FLUID EJECTOR

(75) Inventors: Christoph Menzel, New London, NH (US); Masakazu Okuda, San Jose, CA (US); Steven H. Barss, Wilmot Flat, NH (US)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 13/297,433

(22) Filed: Nov. 16, 2011

(65) Prior Publication Data

US 2012/0127230 A1 May 24, 2012

Related U.S. Application Data

(62) Division of application No. 12/635,567, filed on Dec. 10, 2009.

(51) Int. Cl.
*B41J 29/393* (2006.01)
*B41J 29/38* (2006.01)

(52) U.S. Cl. ..... 347/19; 347/11

(58) Field of Classification Search ..... 347/11, 347/19

See application file for complete search history.

(56) References Cited

U.S. PATENT DOCUMENTS

| | | | | |
|---|---|---|---|---|
| 4,593,291 | A | 6/1986 | Howkins | |
| 4,625,221 | A | 11/1986 | Mizuno et al. | |
| 4,630,072 | A | 12/1986 | Scardovi et al. | |
| 4,752,790 | A | 6/1988 | Scardovi | |
| 5,170,177 | A | 12/1992 | Stanley et al. | |
| 5,502,468 | A | 3/1996 | Knierim | |
| 6,161,912 | A * | 12/2000 | Kitahara et al. | 347/9 |
| 6,331,040 | B1 | 12/2001 | Yonekubo et al. | |
| 6,616,258 | B2 | 9/2003 | Maeda | |
| 7,281,778 | B2 * | 10/2007 | Hasenbein et al. | 347/11 |
| 2002/0126167 | A1 * | 9/2002 | Kimura | 347/11 |
| 2006/0164450 | A1 | 7/2006 | Hoisington et al. | |
| 2007/0257948 | A1 | 11/2007 | Kim et al. | |
| 2008/0074451 | A1 * | 3/2008 | Hasenbein et al. | 347/11 |
| 2008/0150983 | A1 | 6/2008 | Sasaki | |
| 2008/0170088 | A1 | 7/2008 | Letendre et al. | |
| 2008/0266340 | A1 | 10/2008 | Williams et al. | |
| 2009/0295853 | A1 * | 12/2009 | Hosono et al. | 347/10 |
| 2010/0141698 | A1 * | 6/2010 | Suzuki et al. | 347/11 |

* cited by examiner

*Primary Examiner* — Julian Huffman

(74) *Attorney, Agent, or Firm* — Fish & Richardson P.C.

(57) ABSTRACT

A method for causing fluid to be ejected from a fluid chamber of a jet in a printhead. An actuator is actuated with a first energy imparting pulse to push fluid away from the actuator and toward a nozzle. Following a lapse of a first interval, the actuator is actuated with second energy imparting pulse to push fluid away from the actuator and toward the nozzle. Following a lapse of a second interval as measured from the second energy imparting pulse, the actuator is actuated with a break-off pulse to cause fluid extending out of an orifice of the nozzle to break off from fluid within the nozzle, wherein the second lapse is longer than the first lapse and is an inverse of the meniscus-jet mass frequency.

8 Claims, 10 Drawing Sheets

SEPARATION OF DRIVE PULSES FOR FLUID EJECTOR

CROSS-REFERENCE TO RELATED APPLICATIONS

This application is a divisional of U.S. application Ser. No. 12/635,567 filed Dec. 10, 2009, which is incorporated by reference.

TECHNICAL FIELD

This disclosure relates to fluid ejection.

BACKGROUND

In a piezoelectric ink jet printer, a print head includes a large number of ink chambers, each of which is in fluid communication with an orifice and with an ink reservoir. At least one wall of the ink chamber is coupled to a piezoelectric material. When actuated, the piezoelectric material deforms. This deformation results in a deformation of the wall, which in turn launches a pressure wave that ultimately pushes ink out of the orifice while drawing in additional ink from an ink reservoir.

To provide greater density variations on a printed image, it is often useful to eject ink droplets of different sizes from the ink chambers. One way to do so is to sequentially actuate the piezoelectric material. Each actuation of the piezoelectric material causes a volume of ink to be pumped out the orifice. If the actuations occur at a sufficiently high frequency, such as at resonant frequency or at a frequency that is higher than the resonant frequency of the ink chamber, and at appropriate velocities, successive volumes will be pumped out of the orifice and will combine in flight to form a single drop on the substrate. The size of this one droplet depends on the number of times actuation occurs before the droplet begins its flight from the orifice to the substrate.

SUMMARY

In one aspect, a method for causing fluid to be ejected from a fluid chamber of a jet in a printhead is described. An actuator is actuated with a first energy imparting pulse to push fluid away from the actuator and toward a nozzle. Following a lapse of a first interval, the actuator is actuated with second energy imparting pulse to push fluid away from the actuator and toward the nozzle. Following a lapse of a second interval as measured from the second energy imparting pulse, the actuator is actuated with a break-off pulse to cause fluid extending out of an orifice of the nozzle to break off from fluid within the nozzle, wherein the second lapse is longer than the first lapse and is an inverse of the meniscus jet mass frequency.

In another aspect, a method of creating a multipulse burst for a jet is described. A first test pulse and a second test pulse of a two pulse burst to a jetting structure is sent to a jet. A velocity of fluid in the jet caused by the second test pulse of the burst is measured. A time between the first test pulse and the second test pulse of the two pulse burst is incrementally increased. A velocity of fluid in the jet caused by the second test pulse of the burst after the time has been incrementally increased. A time between the first test pulse and the second test pulse is plotted against velocity to form a plot, wherein the plot is based on a plurality of incrementally increased times between first and second test pulses. A first velocity peak and a second velocity peak are found in the plot. A multipulse burst is created, wherein a time between a first burst pulse and a second burst pulse in the multipulse burst is a time from 0 to the first velocity peak in the plot and a time between the second burst pulse and a third burst pulse in the multipulse burst is a time from 0 to the second velocity peak in the plot.

In yet another aspect, a system for causing fluid to be ejected is described. The system includes a printhead and a controller. The printhead has a jet, wherein the jet includes a fluid chamber, an actuator and a nozzle with an orifice. The controller is in electrical contact with the actuator and sends electrical signals to actuate the actuator with a first energy imparting pulse to push fluid away from the actuator and toward the nozzle, following a lapse of a first interval, actuate the actuator with second energy imparting pulse to push fluid away from the actuator and toward the nozzle and following a lapse of a second interval as measured from the second energy imparting pulse, actuate the actuator with a break-off pulse to cause fluid extending out of the orifice of the nozzle to break off from fluid within the nozzle, wherein the second lapse is longer than the first lapse and is an inverse of the meniscus jet mass frequency.

Implementations of the methods and techniques described above can include one or more of the following. The first lapse can be the inverse of the resonance frequency of the jet. The first energy imparting pulse, the second energy imparting pulse and the break-off pulse can all be part of a single multipulse burst; and an amplitude of the break-off pulse can have an absolute value that is greater than the amplitude of any other pulse during the single burst. The first energy imparting pulse, the second energy imparting pulse and the break-off pulse can all part of a single multipulse burst and the single multipulse burst can have between four and six pulses. The lapse between each energy imparting pulse prior to the break-off pulse can be equal in time. Jetting using the first interval and second interval can produce fewer satellite droplets than jetting a droplet using a timing between every pulse in a multipulse burst based on the resonance frequency of the jet. The multipulse burst can include a dampening pulse after the break-off pulse. Actuating the actuator with a first energy imparting pulse can cause a first volume of fluid to exit the orifice, actuating the actuator with the second energy imparting pulse can cause a second volume of fluid to exit the orifice, actuating the actuator with a break-off pulse can cause a third volume of fluid to move from within the nozzle to exit the orifice and the third volume can be greater than the first volume and the second volume. Actuating the actuator with a first energy imparting pulse can cause a first volume of fluid to exit the orifice, actuating the actuator with the second energy imparting pulse can cause a second volume of fluid to exit the orifice, actuating the actuator with a break-off pulse can cause a third volume of fluid to move from within the nozzle to exit the orifice and the third volume can move at a higher velocity than the first volume and the second volume are moving at when the break-off pulse is imparted. The time from 0 to the first velocity peak can be an inverse of the resonance frequency of the jet. And the time from 0 to the second velocity peak can be an inverse of the meniscus-jet mass frequency.

In some implementations, one or more of the following advantages may be provided by the devices or burst structures described herein. Ink droplets of various sizes can be ejected from a jetting device both efficiently and accurately. The internal frequency of a waveform or burst is set can prevent the formation of satellite droplets being ejected from the device. Ejection of fewer satellite droplets can improve the acuity and crispness of the printed image. Ejection of fewer satellite droplets can also prevent ink from landing on the nozzle plate and causing misfiring. In addition, jetting can be made more stable. For example, ingestion of air into a jet can be prevented. When air ingestion is prevented, more jets can function as they should. This can lead to more accurate printing results. Using the techniques described herein, a multipulse burst can be generated that uses lower voltage for a given ejection speed to produce the higher volume, and improves stability of the jetting with fewer satellites.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Methods of jetting droplets to reduce the number of satellite droplets and improve droplet location on a receiver are described. The techniques for selecting the time between pulses in a multipulse burst are explained. The timing between pulses is determined utilizing a number of different resonant frequencies inherent to the jet.

Figure 1:
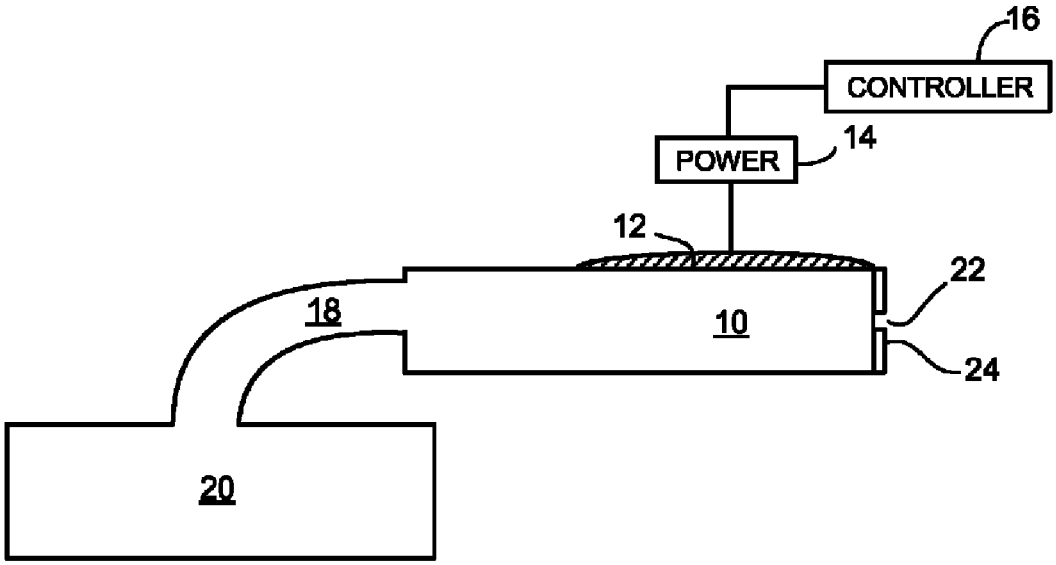
FIG. 1 is a schematic of a fluid chamber of a print head.

FIG. 1 shows a fluid chamber or pumping chamber 10 of one of many ink jets in a piezoelectric print head of an fluid jet printer, such as an ink jet printer. The pumping chamber 10 has an active wall 12 coupled to a piezoelectric material that is connected to a power source 14, e.g., a voltage source, under the control of a controller 16. For example, the piezoelectric material can be sandwiched between two electrodes that are coupled to a voltage source. The controller 16 is in electrical contact with the actuator and is configured to send electrical signals to the actuator. A passageway 18 at one end of the pumping chamber 10 provides fluid communication with a fluid reservoir 20 shared by many other fluid chambers (not shown) of the print head. At the other end of the pumping chamber 10, an orifice 22 formed in a nozzle plate 24 provides fluid communication with the air external to the pumping chamber 10. The nozzle referred to herein includes both the orifice in the plane of the surface of the nozzle plate and at least part of the structure between the orifice and the pumping chamber. Note that in some jetting devices, the pumping chamber is not directly adjacent to the nozzle orifice. That is, there can be a descender or other structure between the nozzle and the pumping chamber.

In operation, the controller 16 receives instructions indicative of a size of a drop to be ejected. On the basis of the desired size, the controller 16 applies an excitation waveform, e.g., a time-varying voltage, or burst to the active wall 12. The term "burst" is used herein to describe an excitation waveform that includes multiple closely spaced pulses or voltage spikes used in combination to produce a single drop.

The burst includes a selection of one or more pulses from a palette of pre-defined pulses. Most of the pulses extrude fluid through the orifice 22 and are ejection pulses, although there can be one or more pulses during a burst that cancel the effect of previous pulses rather than act to eject fluid. The number of ejection pulses selected from the palette and assembled into a particular excitation burst depends on the size of the desired drop. In general, the larger the drop sought, the greater the amount of fluid needed to form it, and hence, the more ejection pulses the excitation burst will contain.

Each ink jet has a natural frequency, $f_j$, which is related to the inverse of the period of a sound wave propagating through the length of the ejector (or jet). The jet natural frequency can affect many aspects of jet performance. For example, the jet natural frequency typically affects the frequency response of the printhead. Typically, the jet velocity remains constant (e.g., within 5% of the mean velocity) for a range of frequencies. Residual pressures and flows from the previous drive pulse(s) interact with the current drive pulse and can cause either constructive or destructive interference, which leads to the droplet firing either faster or slower than it would otherwise fire. Constructive interference increases the effective amplitude of a drive pulse, increasing droplet velocity. Conversely, destructive interference decreases the effective amplitude of a drive pulse, thereby decreasing droplet velocity.

The pressure waves generated by drive pulses reflect back and forth in the jet at the natural or resonant frequency of the jet. The pressure waves, nominally, travel from their origination point in the pumping chamber, to the ends of the jet, and back under the pumping chamber, at which point they would influence a subsequent drive pulse. However, various parts of the jet can give partial reflections adding to the complexity of the response.

In general, the natural frequency of an ink jet varies as a function of the ink jet design and physical properties of the ink being jetted. In some embodiments, the natural frequency of ink jet is more than about 15 kHz. In other embodiments, the natural frequency of ink jet is about 30 to 100 kHz, for example about 60 kHz or 80 kHz. In still further embodiments, the natural frequency is equal to or greater than about 100 kHz, such as about 120 kHz, about 160 kHz, or up to 400 kHz.

Figure 2:
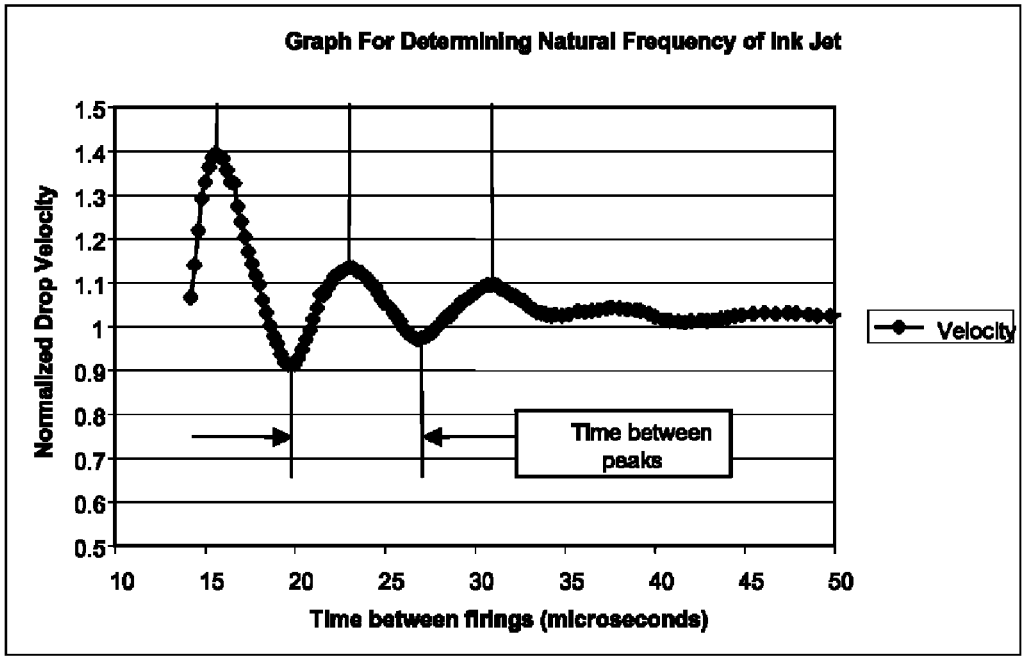
FIG. 2 is a plot of normalized droplet velocity versus time between fire pulses for droplet ejection from a droplet ejector firing at a constant rate.

One way to determine the jet natural frequency is from the jet velocity response, which can readily be measured. The periodicity of droplet velocity variations corresponds to the natural frequency of the jet. Referring to FIG. 2, the periodicity of droplet velocity variations can be measured by plotting droplet velocity versus the inverse of the pulse frequency, and then measuring the time between the peaks. The natural frequency is $1/\tau$, where $\tau$ is the time between local extrema (i.e., between adjacent maxima or adjacent minima) of the velocity vs. time curve.

Figure 3:
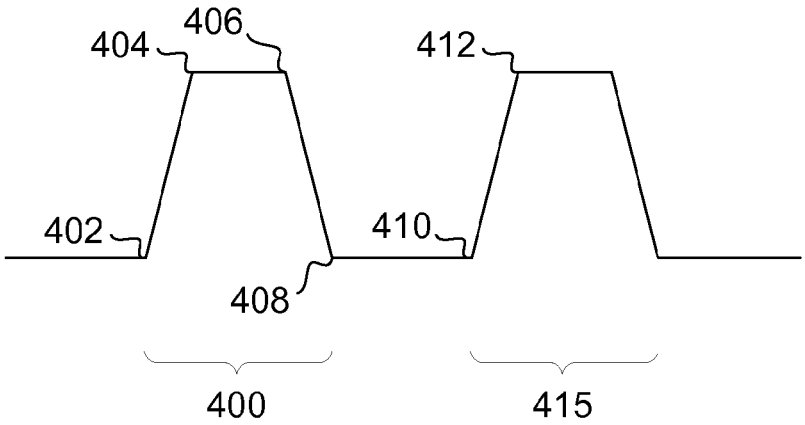
FIG. 3 shows an exemplary multipulse burst.
Figure 4A:
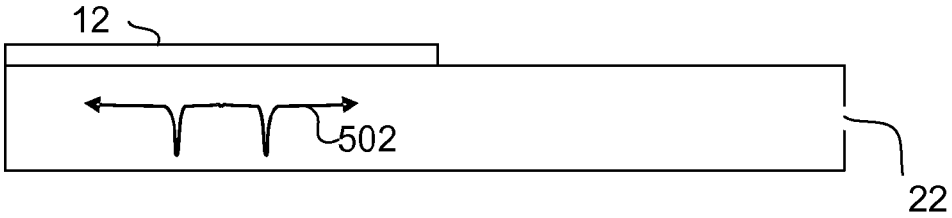
FIGS. 4*a*-4*e* show the energy movement within the fluid in the jet.
Figure 4B:
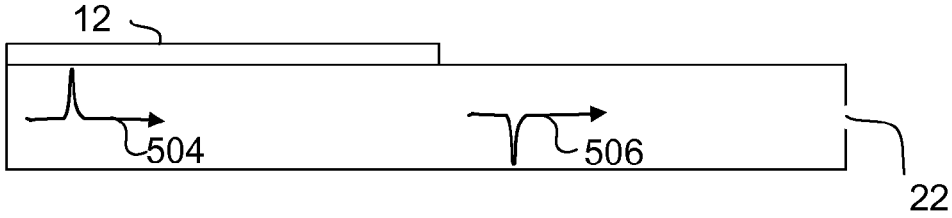
Figure 4C:
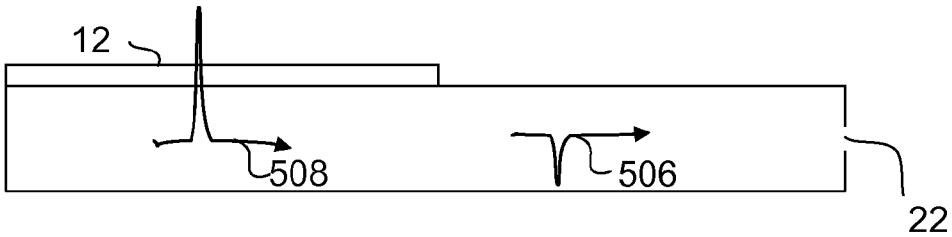

As indicated above, when designing a jetting pulse for a single or multipulse burst, the timing of each portion of the pulse can be related to the resonant frequency. It can be energy efficient if the rising and falling edges of the jetting pulse are timed so that the energy within the system is additive. Referring to FIGS. 3 and 4*a*, a first pulse 400 and a second pulse 415 are shown. During the first pulse 400, between points 402 and 404, a negative pressure is created in the pumping chamber, such as by the actuator causing the pumping chamber to expand. This causes a pressure wave 502 to extend away from the pumping chamber toward the orifice 22 and the end of the jet. Referring to FIGS. 3 and 4*b*, between points 404 and 406 the pulse is timed to wait for the pressure wave to reflect off of the end of the jet that is opposite to the orifice 22, forming reflected wave 504. Due to the impedance mismatch between the jet and the reservoir, the sign of the pressure wave changes. The portion of the initial pressure wave 502 that is traveling towards the orifice 22, portion 506, continues on its trajectory. Referring to FIGS. 3 and 4*c*, the timing of point 406 is when the pressure wave 504 is at the center of the pumping chamber. Between points 406 and 408, a positive pressure wave is generated by the actuator, such as by causing the pumping chamber to contract. This positive pressure wave that is generated adds to the reflected pressure wave 504 to create pressure wave 508. If the timing were chosen so that the pressure wave is not additive, cancellation would result in lost energy rather than increased energy of the wave. Note that the increased energy is shown as a larger wave size.

Figure 4D:
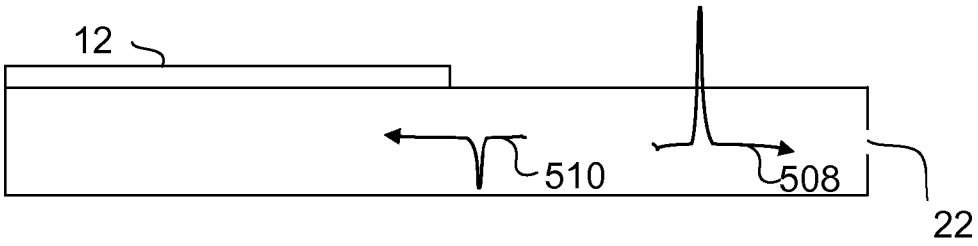
Figure 4E:
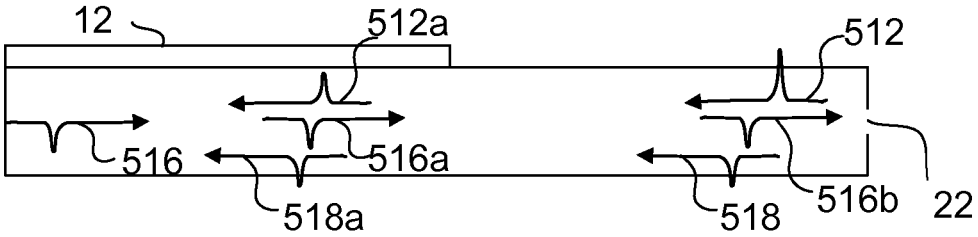

Referring to FIGS. 3 and 4*d*, when a second pulse 415 comes after the first pulse 400, the timing between the end of the first pulse, point 408 and the beginning of the second pulse, point 410 is selected to wait for drop ejection. Pressure wave 510 is the reflected wave 506 after it bounces off of the nozzle region surrounding orifice 22. The pressure wave sign does not change, because the impedance of the nozzle is very high. Pressure wave 510 is no longer of interest and while it still exists, is not shown in the following figure. Referring to FIGS. 3 and 4*e*, the waiting time includes waiting for the wave 508 to reflect off of the nozzle to form wave 512 and return to the pumping chamber, see wave 512*a*. Some of the energy of the wave 512 that returns from the nozzle is lost in comparison to wave 508, because a portion of the wave results in fluid being ejected out of the orifice 22. The positive reflected wave 512 from the nozzle does not change sign. The reflected wave 512*a* travels to the pumping chamber and then reflects off of the back of the jet, resulting reflected wave 516, which changes sign. The negative reflected wave 516*a* travels back through the pumping chamber and on to the nozzle (wave 516*b*). Because the reflected wave 516*b* is negative, it cannot be used to generate a droplet. The reflected wave 516*b* again reflects off of the nozzle, resulting in wave 518, which travels back to the pumping chamber, where is it wave 518*a*. When wave 518*a* is within the pumping chamber, expanding the pumping chamber will add new energy to wave 518*a* (similar to the leftmost part of wave 502 in FIG. 4*a*). Thus, at this time, between points 410 and 412 in second pulse 415 in FIG. 3, it is desirable to fill the pumping chamber. Filling the pumping chamber when energy will be added to the wave causes firing at resonance.

Referring to FIGS. 5*a-f*, one conventional way of forming droplets using a multipulse burst is illustrated. If the pulse frequency is equal to the resonance frequency, i.e., the time between each pulse of the burst is equal to the inverse of the resonance frequency of the jet, jetting can be very energy efficient. That is, for a droplet of a given size, the lowest voltage (compared to other pulse frequencies) can be used to eject the droplet. However, as shown, using the jetting frequency alone to set the time between actuation pulses does not always provide the desired result. In part, this is due to the fact that at resonance the fluid meniscus oscillates greatly between being within the nozzle and extending outwardly from the orifice. Much energy is imparted to the fluid in the nozzle, which can cause some undesirable effects.

Figure 5A:
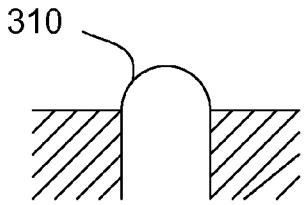
FIGS. 5*a-f* are schematic figures showing ejection of fluid using multiple pulses.
Figure 5B:
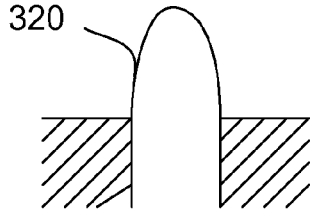

A first pulse of the multipulse burst is delivered to the piezoelectric material and hence the pumping chamber. The multipulse burst here includes four pulses. Referring to FIG. 5*a*, this causes an amount of fluid to be ejected from the orifice. The fluid has a fluid surface 310, which is radially symmetric and somewhat rounded at its end. Following the waiting phase, the controller begins an ejection phase. In the ejection phase, the piezoelectric material deforms so as to expand the pumping chamber. This initiates a second pressure wave. By correctly setting the duration of the waiting phase, as described above with respect to FIGS. 3 and 4*a*-4*e*, the first and second pressure waves can be placed in phase and therefore be made to add constructively. The combined first and second pressure waves thus extrude more fluid through the orifice. Referring to FIG. 5*b*, the first amount of fluid (from the first pulse) and second amount of fluid (from the second pulse) together form fluid surface 320. Fluid surface 320 is greater than and extends further from the nozzle plate and orifice than fluid surface 310. The timing between the first and second pulses is based on the resonance frequency of the jet. In some cases, the timing is a multiple of the resonance frequency.

Figure 5C:
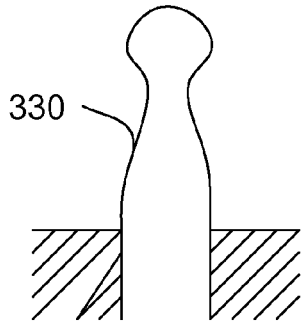
Figure 5D:
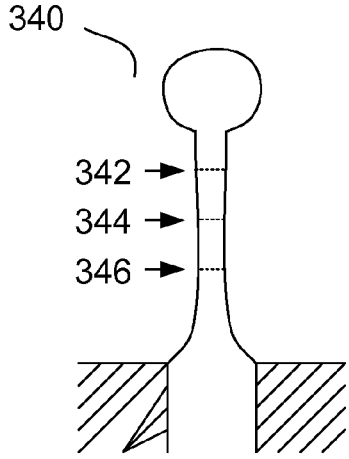

Referring to FIG. 5*c*, a third pulse is delivered to the piezoelectric material. The third pulse causes even more fluid to be added to the fluid expelled from the orifice. Fluid surface 330 now has a bulbous terminal end and a somewhat elongated neck between the orifice and the terminal end. Referring to FIG. 5*d*, yet a fourth pulse is delivered to the actuator, the fourth pulse causing the bulbous terminal end of the fluid surface 340 to grow larger and the elongated neck between the end and the orifice to become thinner and longer. Because of the length of the neck and the action of the meniscus oscillation, the fluid has a tendency to break off at multiple points along the neck. A first break off point 342, which is closest to the terminal end, indicates where the fluid will separate and form the primary drop. A second break off point 344 between the first break off point 342 and the orifice defines along with the first break off point 342 a satellite droplet to the main drop. A third break off point 346 close to the orifice along with the second break off point 344 define a second satellite droplet.

Figure 5E:
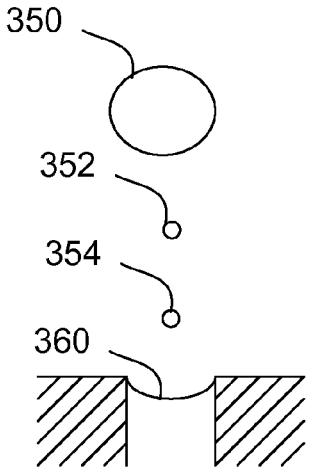

As shown in FIG. 5*e*, a primary droplet 350 is separated from satellite droplets 352 and 354. The primary droplet moves along a trajectory towards the receiver. As shown in the FIG. 5*f*, the primary droplet 350 continues along the main trajectory while the satellite droplets 352 and 354 continue along separate trajectories from the main trajectory. The satellite droplets 352 and 354 have less mass and their movement is therefore more highly affected by electrostatic forces and air pressure. In some cases the satellite droplets may land on the receiver in a location other than the location where the primary droplet 350 lands. In other cases the satellite droplets may land back on the nozzle plate. If the satellite droplets land back on the nozzle plate near an orifice, either the orifice from which they originated or another orifice, they can cause subsequent ejections of fluid to extend from the orifice in a shape that unlike the fluid surfaces 310 and 320 is other than radially symmetrical. For example, the meniscus can bleed onto the nozzle plate adjacent to the orifice. Because the fluid exits the orifice in a non-symmetrical manner, drop ejection can be at an angle or trajectory other than the main or desired trajectory.

Figure 6:
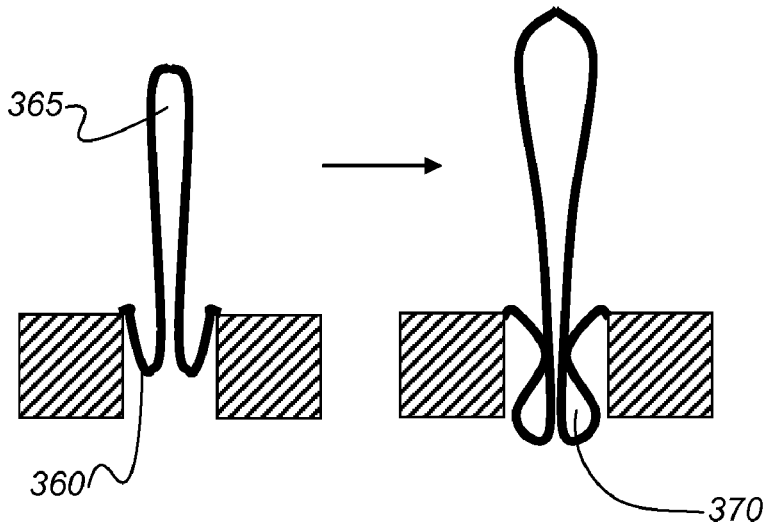
FIG. 6 is a schematic showing a potential jetting problem associated with jetting at resonance frequency.

FIG. 6 shows another potential problem associated with jetting at the resonance frequency. As fluid 365 is ejected out of the orifice, the meniscus 360 can commensurately be pulled back into the nozzle. As more fluid is added to the fluid 365 already extending out of the nozzle and the meniscus begins to oscillate back out of the nozzle, pockets of air 370 can become trapped within the nozzle. These pockets of ingested air can then cause the jetting structure to misfire subsequent droplets. For example, less fluid than is desired may be used to form a droplet or no fluid at all may be ejected from the nozzle when a droplet is desired.

In order to avoid creating satellite droplets, the timing of at least one of the pulses of the burst can be based on a time other than the inverse of the resonance frequency of the jet. In some implementations, both the resonance frequency of the jet, or nominal jet resonance (acoustic travel time), and the acoustic capacitance of the nozzle are used to time the pulses of each burst. The acoustic capacitance of the nozzle in combination with the mass of the fluid results in a meniscus-jet mass resonance. In some implementations, the meniscus jet mass resonance is a less energetic resonance. The meniscus jet mass resonance can be the basis for timing between at least two of the pulses in the burst. In some implementations or structures, the resonance frequency of the jet depends primarily upon the compliance of the pumping chamber and the mass of the fluid within the pumping chamber. In some implementations, the acoustic capacitance of the nozzle is based primarily on the surface tension at the nozzle and the diameter of the nozzle.

Figure 5F:
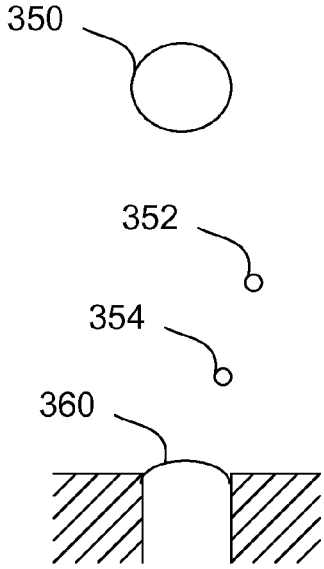

As shown in FIGS. 5*e* and 5*f*, the meniscus 360 oscillates from being within the nozzle to extending outside of the nozzle. The action of the meniscus can be modeled as shown in FIG. 7 to determine the optimal pulse separation and burst separation, as described below.

Figure 7:
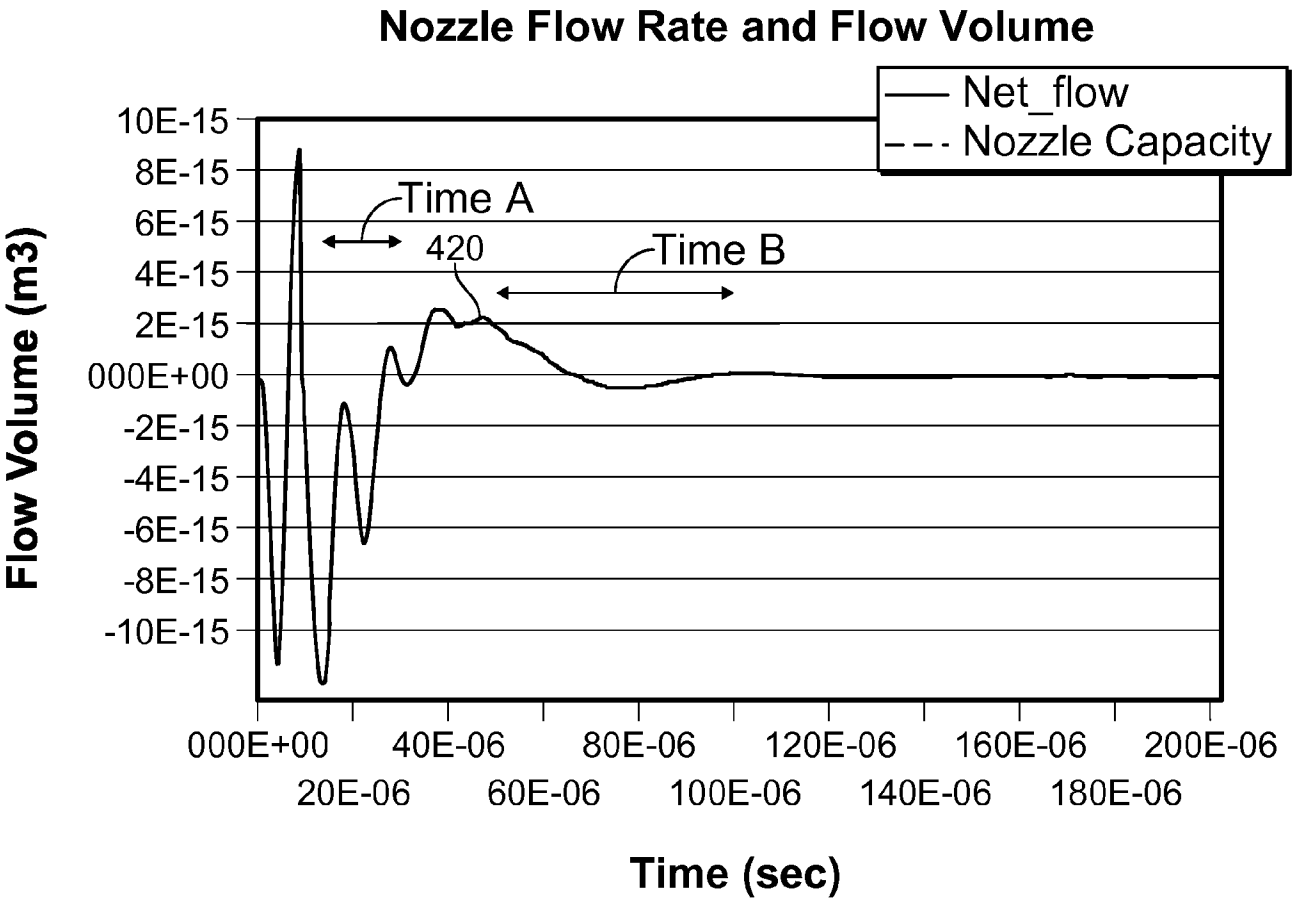
FIG. 7 is model plot of the oscillations of a fluid meniscus as influenced by resonance frequency of the jet and the acoustic capacitance of the nozzle.

Referring to FIG. 7, the resonance frequency and acoustic capacitance can be found or estimated by modeling the flow volume, or flow in the nozzle, as a function of time. As described in more detail below, a designer of a multipulse burst, e.g., an engineer configuring the hardware or software controls for the printhead, can use the modeled data to select the time lapse between bursts. In practice, once the multipulse burst has been created based on this modeled behavior, the timing between the pulses can then be adjusted based on the real world behavior of the jets in the printhead more quickly to achieve satisfactory jetting behavior.

Returning to the modeled data, the model indicates the behavior of a jet when a single pulse is applied. The flow volume (along the y axis) is the volume of flow in the nozzle and not necessarily of flow ejected and separating from the nozzle. That is, the flow volume indicates the action of the meniscus as it oscillates from within the nozzle to outside of the orifice after a pulse is delivered to the pumping chamber. In the model a single pulse of duration shorter than resonance frequency is applied. After the initial perturbation, the ink then oscillates at both the resonance frequency and the meniscus jet mass resonance frequency. The model depends on the fluid characteristics and a jet can be modeled with an exemplary modeling fluid with similar characteristics to the fluid to be ejected. Thus, different bursts can be generated for different types of fluids.

The actuator first causes the pumping chamber to expand, filling the pumping chamber with fluid by pulling the fluid in from a reservoir as well as in from the orifice. Because of the distance between the pumping chamber and orifice, any action of the pumping chamber has a delayed effect at the orifice. Because the model indicates action at the nozzle, nothing occurs immediately at time 0. After time 0, the flow appears to be a negative flow volume. The pumping chamber is then compressed, pushing fluid out of the orifice. The resonance of the jet then causes the meniscus to oscillate, which is seen as the higher frequency sine wave component. Commensurately, the acoustic capacitance of the nozzle with a mass of fluid therein causes a slower oscillation of the meniscus, which is seen as the lower frequency sine wave underlying the higher frequency wave. Thus, the fire pulse adds energy to the system, the system then oscillates at its various resonances. The system resonances filter the input energy and take only the energy at the appropriate frequency. The lower frequency is caused by the resonance of the jet fluidic mass and the nozzle compliance. Thus, the resonance frequency can be derived from a first frequency contribution portion of the plot (the contribution to the waveform of the higher frequency). Specifically, the resonance frequency is equal to the inverse of the time period between adjacent extrema in the first portion of the flow volume plot. The acoustic capacitance of the nozzle can be derived from a second frequency contribution portion of the plot (the contribution having the lower frequency) if one knows the mass of the fluid that the model assumes. Specifically, the frequency of the waveform contribution due to the meniscus-jet mass resonance, is equal to the inverse of the time period between peaks in the slower sine-wave on top of which the resonance frequency is added of the flow volume plot. As can be seen, the resonance frequency is a much faster frequency than the meniscus-jet mass resonance frequency. The period between two peaks in the flow volume generated by the resonance frequency is shown as time A. The period between two peaks in the flow volume generated by the meniscus-jet mass resonance is shown as time B (the peak of the oscillation in the flow volume caused by meniscus-jet mass resonance is at point 420). Note that the acoustic capacitance peak 420 may not coincide with a peak of the resonance frequency. The sine-wave type curve caused by the meniscus-mass resonance can be determined by removing the resonance frequency contribution from the curves. Fourier analysis can be used to separate out frequency contributions.

Figure 8:
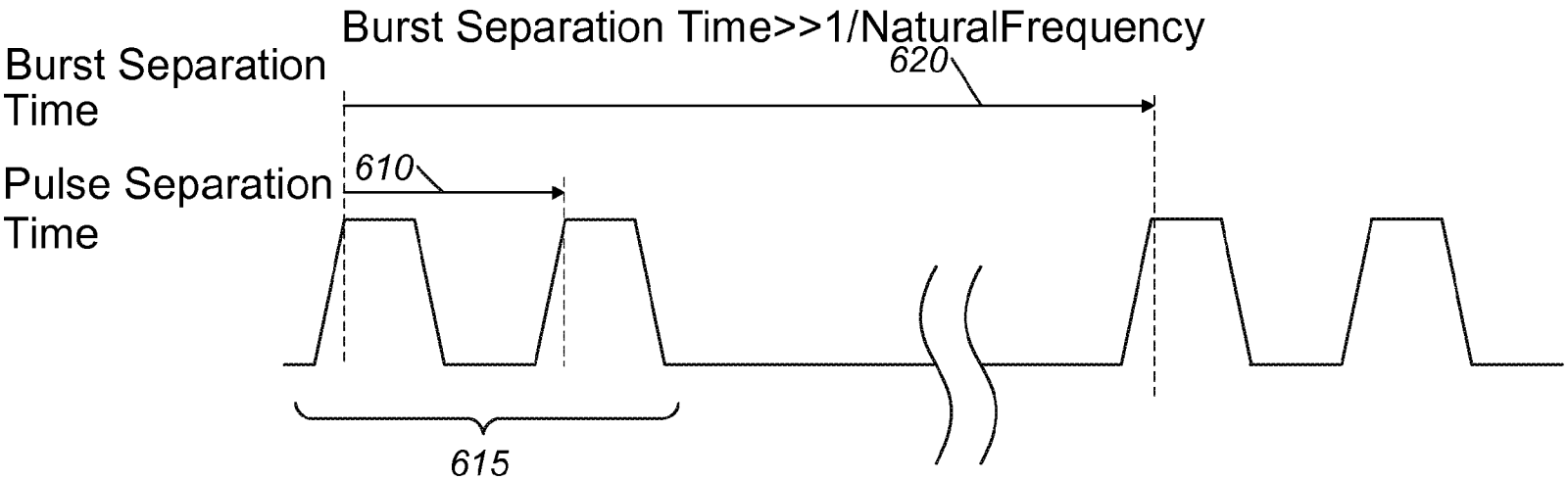
FIG. 8 shows two pulse bursts.
Figure 9:
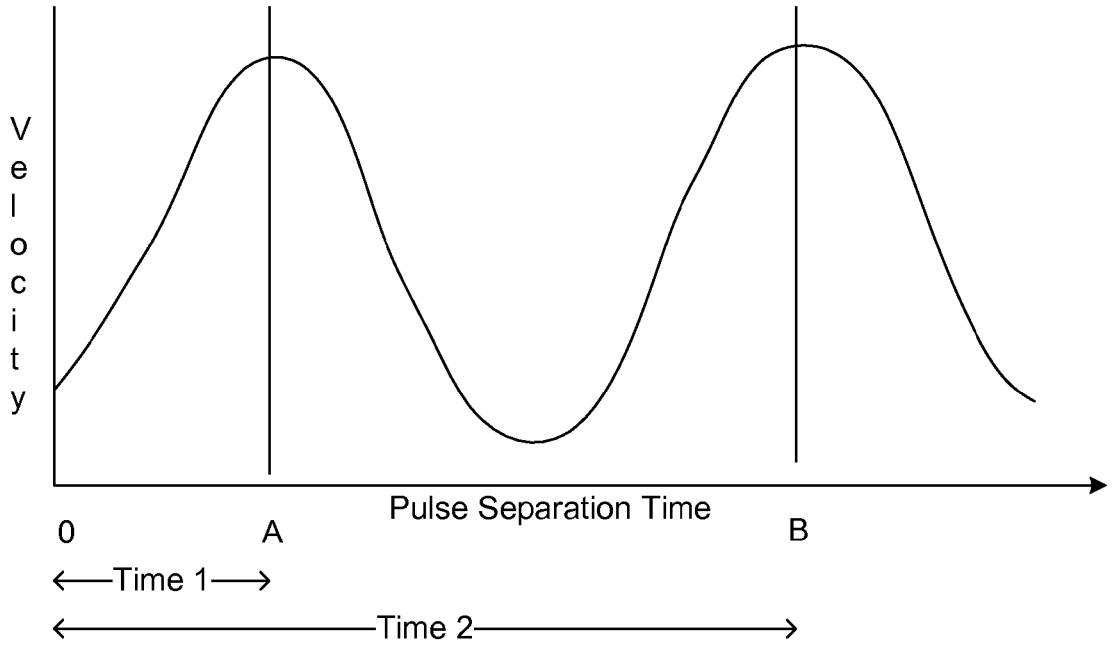
FIG. 9 is a plot of drop ejection velocity according to pulse separation time.

Referring to FIGS. 8 and 9, after the modeled data has been used to find data useful in creating the lapse between pulses in an exemplary multipulse burst, the separation time between two pulses 610 in the burst can be empirically tested and modified to improve a jetting quality, such as one or more of stability, reduced satellites or jetting straightness. The separation time that is tested is the separation time based on the resonance frequency. A two-pulse burst 615 is created based on the faster frequency found from the modeling data. Thus, the timing from the start of the first pulse to the start of the second pulse is the inverse of the resonance frequency from the model.

The system can be monitored using a strobe system. A strobe light is set to go off and an image is obtained at various times during a burst. Because the image capture electronics are too slow to capture sequential images that can be assembled into a "movie", a movie is made by combining images taken at different delays from the firepulse initiation across a number of different pulses. The strobe system can be used to determine the droplet velocity exiting the orifice.

The separation time between the pulses in the burst is then changed. These changes are monitored using the strobe system. The pulse separation time at which the fluid droplet velocity peaks can be used as timing between pulses in the multipulse burst, as described further below. This timing may be the same as the timing found in the model in FIG. 7, or may be somewhat different. In FIG. 8, the first two pulses that are shown are pulses within a single burst. The minimum timing between the first pulse and the third pulse shown in FIG. 8 is the length of time for a burst, which can be estimated by seeing how long it takes for the energy within the nozzle to be completely dampened, for example, by using the modeling FIG. 7. The time for all of the energy to be dampened out can be between 2 and 5 microseconds, in some implementations of jet.

The effect on changing the timing between the two pulses in a single burst is graphed, as shown in FIG. 9. The timing between each pulse in a burst 615 is along the x-axis. The pulse separation time 610 can be varied to determine the velocity of ejection based on the pulse variation time, that is, by adjusting the pulse separation time. The velocity of droplet ejection is graphed along the y-axis. As shown in FIG. 8, only two pulses are delivered to a jet for a burst to generate this information. As was described with respect to FIGS. 3 and 4*a-f*, the first pulse sets the fluid in the jet in motion, which inputs energy to the fluid in the nozzle, causing the meniscus to extend out of the orifice of the nozzle and then oscillate back into the nozzle. The timing of the second pulse then determines whether the energy imparted to the fluid acts constructively or destructively on the fluid in the nozzle. If the meniscus is deep within the nozzle when the second pulse arrives, the drop will in general be slower than if the meniscus were further out. The first peak A in the fluid velocity occurs at the resonance frequency of the jet. A second peak B occurs at a meniscus-jet mass frequency. The time from zero to peak A is equal to time 1. The time from zero to peak B is equal to time 2. Time 2 is always greater than time 1. Time 2 can be used as the time between the break-off pulse and the pulse just preceding the break-off pulse. Thus, when considering all available pulses in a multipulse burst, time 2 is the time between the ultimate pulse or the break off pulse and the penultimate pulse, assuming that there is no energy damping pulse being considered as the ultimate pulse. In the case that the burst includes a dampening pulse as the final pulse, time 2 is between the third to last pulse and the second to last pulse. A dampening pulse is timed to dampen some of the energy within the jet. This can lead to more consistent jetting of droplets. In some instances, time 1 is equal to time A from the modeled data. In some instances, time 2 is equal to time B from the modeled data. However, the empirical testing of the jet determines whether this is true or not.

Although in theory one could skip the step of modeling the jet and simply use the empirical method for finding the pulse separation time, there are a sufficient number of variables that it would be difficult to efficiently find the ideal timing between pulses in the burst. Thus, the modeling data can enable the burst designer to more quickly determine the timing between pulses by providing the burst designer with a starting point.

Once times 1 and 2 have been determined by empirically testing the jets, these times can then be used to select the timing of pulses within of a burst during the printing operation. Each burst includes multiple pulses. Each pulse can be characterized as having a "fill" ramp, which corresponds to when the volume of the pumping chamber increases, and a "fire" ramp (of opposite slope to the fill ramp), which corresponds to when the volume of the pumping chamber decreases. In multipulse bursts there are a sequence of fill and fire ramps. The fill and fire times, or length of the pulse (or width of the pulse) can also be determined empirically.

The results shown in FIG. 9 can be used to determine the resonant frequency of the jet and the meniscus-jet mass frequency of nozzle. Because these frequencies depend on the characteristics of the fluid being jetted, the modeling or empirical testing used to find the frequencies can utilize the characteristics of the fluid that will be jetted. These frequencies can be used to determine the minimum length of the burst or the burst separation time, as well as the timing between some of the pulses in the burst. Typically, the burst length or burst separation time is set by specification through a drop firing frequency requirement. The burst length cannot exceed this specification if each nozzle is able to be fired from continuously. The burst length can be set by how often it is desired that the droplets are ejected, which is typically as fast as possible. In some implementations, the frequency is greater than 10 kHz, such as 20 or 25 kHz, and can be up to 200 kHz.

The results shown in FIG. 9 are then used to determine the time between the early pulses in the burst, or the energy imparting pulses, and the time between the break-off pulse and the pulse just preceding the break-off pulse and form the burst. These times and frequencies can be stored in memory. When it comes time to print, the size of the desired droplet determines which of the pulses in a burst are used to form the droplet. The pulses from the burst that create the desired droplet size are then generated by the controller to eject the desired droplet size at the desired time. Because there are many jets in a single printhead and potentially many printheads firing simultaneously, the multipulse burst is applied to, or not applied when no droplet is desired, the multiple jets either simultaneously or in a timed fashion to cause the ejection of the droplets to be properly synchronized so that the desired image is produced on a receiver by ejection of the droplets.

Figure 10:
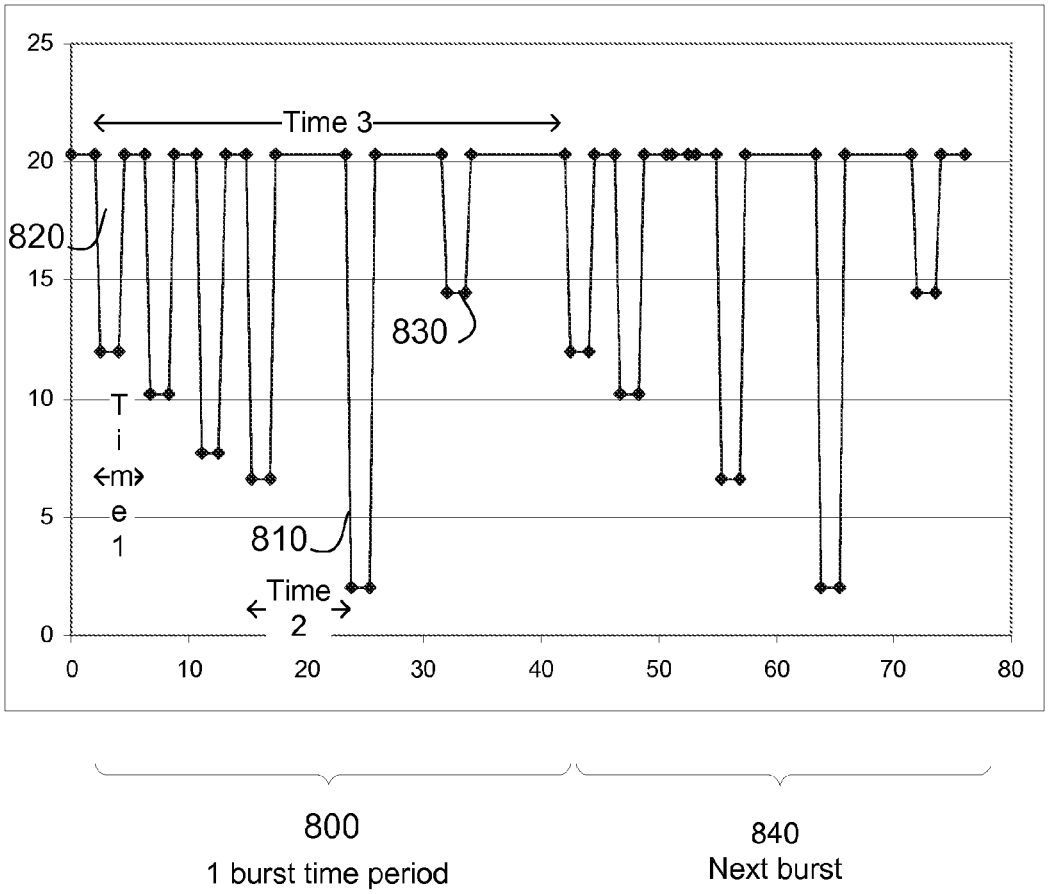
FIG. 10 is an exemplary waveform or burst for ejecting a droplet.

Referring to FIG. 10, only a single droplet can be ejected during a single burst time period. Each burst time period for all jets in a die and during a printing process are equal to one another. The burst time period is selected to be time 3, which is greater than time 2 plus time 1 times how many energy imparting pulses $P_e$ minus 1 precede the break off pulse $P_b$.

$$\text{Burst time period } (=\text{Time } 3) > \text{Time } 2 + \text{Time } 1\ (P_e - 1)$$

The pulse in the burst that causes the fluid droplets to separate from the fluid in the nozzle is referred to as the break-off pulse. The break-off pulse is an ejection pulse as well.

The first burst 800 shown includes six pulses. In some implementations, the break-off pulse 810 has the greatest amplitude of all pulses during the burst. In some implementations, each pulse preceding the break-off pulse has the same amplitude as the other preceding pulses. In some implementations, each preceding pulse has a different amplitude. For example, the amplitude of the pulses can increase monotonically. The earliest pulse 820 in the burst may have the smallest amplitude, and the amplitude may increase linearly or nonlinearly with time for each pulse in the burst. Alternatively, the increase can be other than monotomical or can be varied. Other bursts may include more or fewer pulses. For example a burst may include only two pulses, three pulses, four pulses, five pulses or even more pulses. The maximum number of pulses utilized in a burst can be used to eject the maximum droplet size. Smaller droplets can be ejected by selecting one or more of the pulses preceding the break-off pulse in combination with the final pulse. For example, a fluid droplet formed from two quantities of ink can be formed by the first and final ejection pulses, the penultimate and final ejection pulses, or any of the other pulses in combination with the final pulse. The pulse amplitude can control the momentum of the fluid ejected by the ejection pulse. As shown in the next burst 840, the first, second, fourth and final ejection pulses are used to form a droplet. Thus, the pulses that are selected for a droplet need not be consecutive pulses. Optionally, a cancelling pulse 830 can follow the final ejection pulse or break-off pulse 810. The cancellation pulse 830 can prevent any residual motion of the meniscus from affecting subsequently jetted droplets. If no fluid is desired to be ejected in a subsequent time, none of the pulses of a burst are delivered to the actuator.

Although the time of the burst is shown as measured from the beginning of a first ejection pulse in a first burst to the first ejection pulse in an immediately subsequent burst, the burst timing can also be measured from one break-off pulse in one burst to a break-off pulse in the immediately following burst.

Although FIG. 10 shows downwardly extending pulses, this is not meant to imply anything about the actual signs of voltages and currents used in driving circuitry. The pulses are also shown as trapezoidal pulses, however, other pulse shapes could alternatively be applied.

Figure 11A:
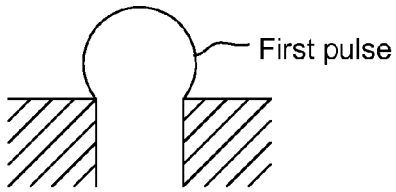
FIGS. 11*a-f* are a schematic showing exemplary ejection of fluid using multiple pulses, where the burst is structured as described herein.
Figure 11B:
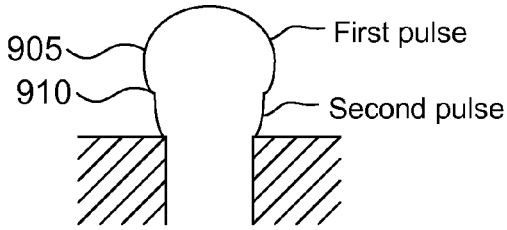
Figure 11C:
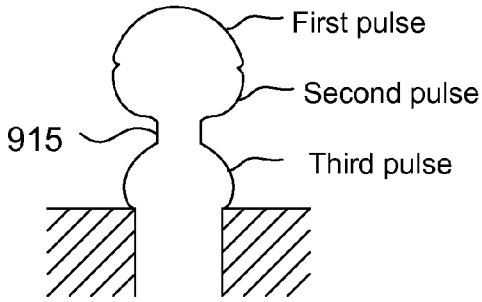
Figure 11D:
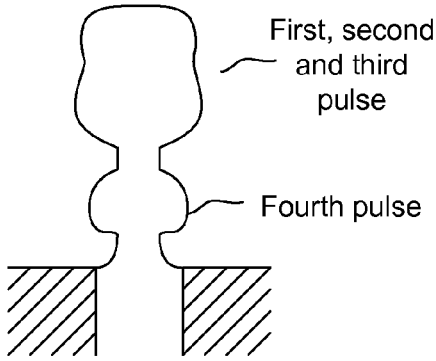
Figure 11E:
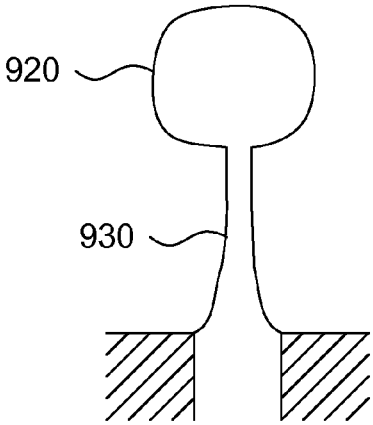

Referring to FIGS. 11*a-e*, a droplet formed using four pulses is shown. Referring to FIGS. 11*a* and 11*b*, a first pulse ejects a first volume of fluid from the orifice and a second pulse ejects a second volume of fluid from the orifice, which adds to the first volume. The volumes of fluid from the different pulses may be distinguishable from one another if viewed with a camera. For example, the droplet formation can be viewed stroboscopically, as described above. As each volume of fluid is added to the droplet during formation, an outline of the droplet when viewed from its side or along an angle parallel to the nozzle plate shows outwardly bulging or curved areas 905 that are the volume ejected by a pulse with an inwardly curving region 910 (see FIG. 11*b*) or a narrow region 915 (see FIG. 11*c*) that is between the two volumes. In FIG. 11*c*, a third pulse adds yet more fluid to the fluid from the first and second pulses. The fourth pulse or break-off pulse, which is the pulse of the greatest amplitude and causes the droplet to break off from the fluid in the nozzle, causes the ejected fluid to have sufficient velocity to catch up with the fluid ejected by the first, second and third pulses, as shown in FIG. 11*d*. In some implementations, the velocity of the fluid energized by the break-off pulse is greater than the velocity of the fluid that is outside of the orifice when the break-off pulse occurs. As noted above, the volume of the fluid of each energy imparting pulse can be similar or different. For example, each energy pulse can cause a greater amount of fluid to exit the orifice than the preceding pulse in the burst. In some implementations, the volume of fluid that the break-off pulse causes to exit the orifice is greater than the amount of fluid caused to exit the orifice by any of the energy imparting pulses. Just prior to break-off, the droplet 920 is a bulbous mass of fluid connected to fluid in the nozzle by a long tail narrow 930, as shown in FIG. 11*e*.

Figure 11F:
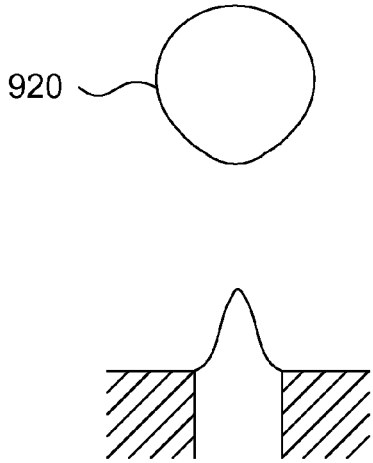

FIG. 11*f* shows the droplet 920 after break-off. Although no satellites are shown when the droplet breaks off in FIG. 11*f*, it is difficult to jet each droplet without satellite droplets. However, the structure of the bursts described herein reduce the number of satellites that are formed when other bursts are used to eject fluid droplets. The burst can also control the direction of the satellite droplets that are ejected, such as to improve uniformity of the direction of the satellite droplets. Alternatively, or in addition, structuring a burst as described herein can adjust the size of the satellite droplets.

This is because applying a break-off pulse when the meniscus is slightly protruded due to the oscillations dependent on the acoustic capacitance tends to create more stable jetting and straighter droplet trajectories. The jet resonance alone can create a great amount of wild motion. This wild motion can cause jetting to be unstable. Thus, finding a time to pulse that coincides only with fluid protrusion from the orifice may be insufficient to prevent satellite drops, air ingestion, or crooked jetting. Thus, using the meniscus jet mass frequency for the break-off pulse timing can result in improved jetting. Using the inverse of the jet resonance frequency as timing between some pulses, e.g., the early pulses in the burst, can also be beneficial as this provides a lot of mass motion to the fluid in the nozzle for an input voltage to the actuator.

Implementations of the subject matter and the operations described in this specification, in particular related to the controller, can be implemented in digital electronic circuitry, or in computer software, firmware, or hardware, including the structures disclosed in this specification and their structural equivalents, or in combinations of one or more of them. Implementations of the subject matter described in this specification can be implemented as one or more computer programs, i.e., one or more modules of computer program instructions, encoded on computer storage medium for execution by, or to control the operation of, data processing apparatus. Alternatively or in addition, the program instructions can be encoded on an artificially generated propagated signal, e.g., a machine-generated electrical, optical, or electromagnetic signal, that is generated to encode information for transmission to suitable receiver apparatus for execution by a data processing apparatus. A computer storage medium can be, or be included in, a computer-readable storage device, a computer-readable storage substrate, a random or serial access memory array or device, or a combination of one or more of them. Moreover, while a computer storage medium is not a propagated signal, a computer storage medium can be a source or destination of computer program instructions encoded in an artificially generated propagated signal. The computer storage medium can also be, or be included in, one or more separate physical components or media (e.g., multiple CDs, disks, or other storage devices).

The operations described in this specification can be implemented as operations performed by a data processing apparatus on data stored on one or more computer-readable storage devices or received from other sources.

The term "data processing apparatus" encompasses all kinds of apparatus, devices, and machines for processing data, including by way of example a programmable processor, a computer, a system on a chip, or multiple ones, or combinations, of the foregoing. The apparatus can include special purpose logic circuitry, e.g., an FPGA (field programmable gate array) or an ASIC (application specific integrated circuit). The apparatus can also include, in addition to hardware, code that creates an execution environment for the computer program in question, e.g., code that constitutes processor firmware, a protocol stack, a database management system, an operating system, a cross-platform runtime environment, a virtual machine, or a combination of one or more of them. The apparatus and execution environment can realize various different computing model infrastructures, such as web services, distributed computing and grid computing infrastructures.

The processes and logic flows described in this specification can be performed by one or more programmable processors executing one or more computer programs to perform actions by operating on input data and generating output. The processes and logic flows can also be performed by, and apparatus can also be implemented as, special purpose logic circuitry, e.g., an FPGA (field programmable gate array) or an ASIC (application specific integrated circuit).

Processors suitable for the execution of a computer program include, by way of example, both general and special purpose microprocessors, and any one or more processors of any kind of digital computer. Generally, a processor will receive instructions and data from a read only memory or a random access memory or both. The essential elements of a computer are a processor for performing actions in accordance with instructions and one or more memory devices for storing instructions and data. Generally, a computer will also include, or be operatively coupled to receive data from or transfer data to, or both, one or more mass storage devices for storing data, e.g., magnetic, magneto optical disks, or optical disks. However, a computer need not have such devices. Devices suitable for storing computer program instructions and data include all forms of non volatile memory, media and memory devices, including by way of example semiconductor memory devices, e.g., EPROM, EEPROM, and flash memory devices; magnetic disks, e.g., internal hard disks or removable disks; magneto optical disks; and CD ROM and DVD-ROM disks. The processor and the memory can be supplemented by, or incorporated in, special purpose logic circuitry.

To provide for interaction with a user, implementations of the subject matter described in this specification can be implemented on a computer having a display device, e.g., a CRT (cathode ray tube) or LCD (liquid crystal display) monitor, for displaying information to the user and a keyboard and a pointing device, e.g., a mouse or a trackball, by which the user can provide input to the computer. Other kinds of devices can be used to provide for interaction with a user as well; for example, feedback provided to the user can be any form of sensory feedback, e.g., visual feedback, auditory feedback, or tactile feedback; and input from the user can be received in any form, including acoustic, speech, or tactile input. In addition, a computer can interact with a user by sending documents to and receiving documents from a device that is used by the user; for example, by sending web pages to a web browser on a user's client device in response to requests received from the web browser.

A number of embodiments have been described. Nevertheless, it will be understood that various modifications may be made. For example, the fluid referred to herein can be ink, but can also be biological materials, electronic material or other materials with suitable viscosity for extruding out of an orifice. Accordingly, other embodiments are within the scope of the following claims.

What is claimed is:

1. A method of creating a multipulse burst for a jet, comprising:

sending a first test pulse and a second test pulse of a two pulse burst to a jet;

measuring a velocity of fluid in the jet caused by the second test pulse of the burst;

incrementally increasing a time between the first test pulse and the second test pulse of the two pulse burst;

measuring a velocity of fluid in the jet caused by the second test pulse of the burst after the time has been incrementally increased;

plotting a time between the first test pulse and the second test pulse against velocity to form a plot, wherein the plot is based on a plurality of incrementally increased times between first and second test pulses;

finding a first velocity peak and a second velocity peak in the plot; and creating a multipulse burst, wherein a time between a first burst pulse and a second burst pulse in the multipulse burst is a time from 0 to the first velocity peak in the plot and a time between the second burst pulse and a third burst pulse in the multipulse burst is a time from 0 to the second velocity peak in the plot.

2. The method of claim 1, wherein the time from 0 to the first velocity peak is an inverse of the resonance frequency of the jet.

3. The method of claim 1, wherein the time from 0 to the second velocity peak is an inverse of the meniscus-jet mass frequency.

4. The method of claim 1, wherein the first burst pulse and second burst pulse push fluid away from an actuator and toward a nozzle.

5. The method of claim 4, wherein the third burst pulse causes fluid extending out of an orifice of the nozzle to break off from fluid within the nozzle.

6. The method of claim 1, wherein an amplitude of the third burst pulse has an absolute value that is greater than the amplitude of any other pulse during the multipulse burst.

7. The method of claim 1, wherein the multipulse burst has between four and six pulses including the first burst pulse, the second burst pulse and the third burst pulse.

8. The method of claim 7, wherein a lapse between each pulse prior to the third burst pulse is equal in time.

* * * * *